United States Patent [19]

Aurness et al.

[11] Patent Number: 5,048,189

[45] Date of Patent: Sep. 17, 1991

[54] WALLBOARD CUTTER

[76] Inventors: Harold O. Aurness, 5808 Knox Ave. No., Brooklyn Center, Minn. 55430; Sidney K. Legg, 3943 Lyndale Ave. N., Minneapolis, Minn. 55412

[21] Appl. No.: 489,516

[22] Filed: Mar. 7, 1990

[51] Int. Cl.[5] ..... B26B 29/06

[52] U.S. Cl. ..... 30/293; 30/294

[58] Field of Search ..... 30/293, 294, 278, 164.9, 30/164.95; 83/292, 745

[56] References Cited

U.S. PATENT DOCUMENTS

| | | | |
|---|---|---|---|
| 2,529,210 | 11/1950 | Butler | 30/294 |
| 3,520,059 | 7/1970 | Gringer | 30/293 |
| 3,644,994 | 2/1972 | Lind | 30/292 |
| 3,837,078 | 9/1974 | Weppner | 30/293 |
| 4,277,889 | 7/1981 | Oberg | 30/164.95 |
| 4,903,409 | 2/1990 | Kaplan et al. | 30/294 |

*Primary Examiner*—Frank T. Yost
*Assistant Examiner*—Allan M. Schrock

[57] ABSTRACT

A wallboard cutter according to the teachings of the present invention is shown as including an open housing comprising an inverted channel with rollers extending partially into the channel at either end to facilitate the movement as the channel is drawn along the edge of the wallboard. A measure rod with digital marks is extended slideably up through the housing parallel with the channel walls with tightening means to the housing. A handle with a cutting blade is rotatably attached to the measure rod at the zero end to cut, or score, the wallboard as the unit is pulled over the wallboard by the unit handle which extends up from the housing in spaced relation to and parallel with the measure rod.

7 Claims, 1 Drawing Sheet

WALLBOARD CUTTER

SUMMARY

The present invention solves the need for a manageable way for a single worker to cut or score a large standard size wallboard by incorporating several operations into one unit.

Specifically, the unit has an open housing comprising a channel which fits over the edge of a wallboard horizontally. The base, or floor, of the channel, which is inverted, having the open side down, extends laterally to form a platform which holds two cube-shaped members spaced apart at each end of the platform to form one wall of the channel with a gap and faces the other channel wall which is solid.

Rollers in wells, one in one of the cube-shaped members on the platform and one diametrically opposite at the back of the other channel wall at the other end, extends partially into the channel, through slots, to facilitate movement through the channel by reducing friction and binding.

A cutter handle with a removeable, adjustable blade is rotatably mounted at 90° to the lower end of a measure rod below the channel. The measure rod extends at a right angle to and through the platform and can be set and tightened at any measure point on the rod. The cutter handle includes a space for carrying extra blades.

A straight unit handle extends up from the platform parallel with the measure rod for pulling the unit across the wallboard while the blade is forced into the material and results in a straight even cut. The gap in one wall of the channel allows for cutting very narrow strips off the edge of the wallboard.

LIST OF ILLUSTRATIONS

DESCRIPTION

Figure 2:
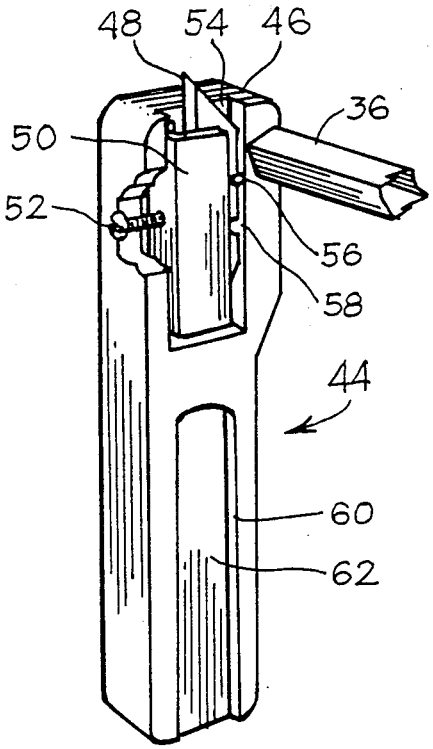
FIG. 2 shows a perspective view of the cutter blade in a vertical position with a parital cut-away showing the blade mounting.
Figure 1:
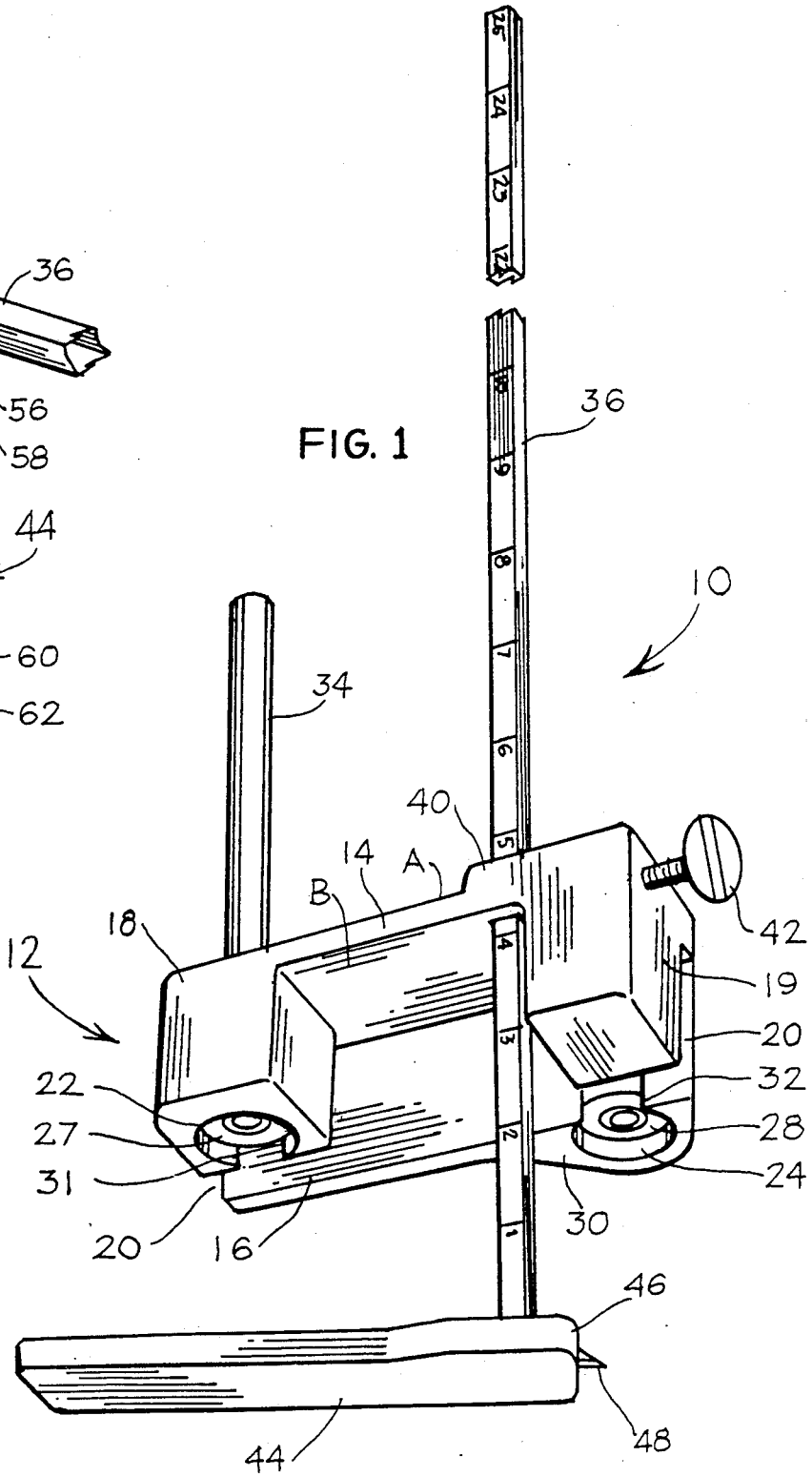
FIG. 1 shows a perspective view of a wallboard cutter from below in the position in which it would generally be used.

A wallboard cutter for cutting/scoring plasterboard is generally shown in the drawings and generally designated 10. Unit 10 comprises a channel housing 12 describing a rectangular platform 14 with a top side A and a bottom side B with a first wall 16 along one long side of the bottom B of the platform 14 approximately equal in dimension to the platform, forming and L-shaped profile. Two box-shaped members 18 and 19, one on each end and within the perimeter of the platform, spaced a small distance from the first wall 16, form a second, broken wall to form a channel 20. The gap in the wall is to provide space for cutting a narrow strip off the wallboard if needed. Channel housing 12 further describes two cylindrical roller wells 22 and 24, upright axially to the bottom side B of the platform 14 holding rollers 26 and 28 secured through the well ceilings and spaced symetrically opposite each other at each end of the channel 20. Well 22 is in the box-shaped member 18 on the platform 14. The other well 24 is in a modified cylinder-shaped molded part 30 at an end and backside of wall 16. The wells 22 and 24 have openings 31 and 32 extending the height of the wells which allows a small section of the circumference of the rollers to extend into the channel space to roll against the material to be cut which mitigates a binding tendency as the unit is pulled across the wallboard edge. A unit handle 34, cylindrical in shape, extends axially up from the ceiling of well 22 in box-shaped member 18 for pulling the unit 210 across the material to be cut.

The channel housing 12 further comprises a measuring rod 36 at least 25" long with a square profile slideably extending through a square hole 38 in the platform 14 near the box-shaped member 19 at 90° to the platform. Platform 14 is provided with additional molded support 40 on the topside A in this area which also provides space for a wing screw 42 for tightening or loosening the measuring rod which measuring rod 36 is sectioned into inch or metric spaces. A cutter handle 44 with generally rectangular sides is rotatably attached near one end 46 at a side location, and at 90° to the zero end of the measuring rod 36, which end extends below the bottomside B of the channel housing 12. An adjustable cutter blade 48, held by means of a removable holding plate 50 and a screw 52, is mounted flush to the topside of the cutter handle 44 at end 46 facing the channel 20 is a wide, shallow slot 54. The cutter blade point extends beyond the end of the cutter handle 44 into the channel 20 when in use and is kept from sliding lengthwise by a holding pin 56 in the slot 54 which fits several adjustment slots 58 in an edge of blade 48. A chamber 60 in the cutter handle 44 is provided to hold extra cutter blades and is covered by a plate 62 secured by holding means to the handle.

We claim:

1. A cutting unit for cutting or scoring wallboard of various thicknesses comprising members forming a channel having first and second ends with a first wall formed of first and second column members, one at each end of the channel, a planar second wall opposite the first wall with a planar floor between a first roller member in the second wall at the first end flush to the channel with a second roller flush to the channel in the first column member at the second end of the channel; with the channel floor also extending laterally between the first and second columns to provide for a sliding measure rod to extend through at 90° to an outer edge of the floor extension near the second column and secured by a wing screw, a rotatable handle with a cutting blade mounted transversely to a zero end of the measure rod; a pulling handle extending upward from the first column member, whereby the unit can be pulled along the edge of the wallboard with the score or cut controlled by hand.

2. The wallboard cutter of claim 1, wherein the channel housing comprises, in combination, an inverted channel with a first and second channel wall with the second channel wall having a gap the full height of the wall in the central part; an extension of the channel floor beyond the second channel wall to provide a place for a slide hole for a measure rod having a rotatable cutting means at its end and for a second hole to provide a screw-tightening means 90° to the slide hole for the measure rod; wherein the gap in the second channel wall provides space for the cutting means to score the narrowest strip desired on the wallboard as the unit is pulled along the wallboard in the channel.

3. The wallboard cutter of claim 1, wherein the cutting means comprises a cutter handle of a generally long broad shape and a narrower thickness attached rotatably at a broad side near one end axially to the end of a measure rod, with a cutting blade secured to the cutter handle at that same end flush to the side of the cutter handle attached to the measure rod with a holding plate covering the blade resulting in a blade off center in the cutter handle, wherein the blade can reach and score a cut very close to the edge of the wallboard limited only by the thickness of the holding plate.

4. The wallboard cutter of claim 3, wherein an end of the cutter handle is attached rotatably to the end of the measure rod off center on a broad side of the cutter handle to allow the operator's hand a more comfortable angle to be able to score as deep or shallow a cut as desired.

5. The wallboard cutter of claim 1 wherein the channel formed by the first and second channel walls combined with a rotatable cutting means axially secured to the end of an adjustable measure rod mounted 90° to the channel is wide enough to allow for a variety of wallboard thicknesses to be scored by the cutting means, due to its rotatable point, by angling the wallboard in the channel along the hypotenuse of the channel and steadied against the opposite ends as the unit is pulled along.

6. The cutting unit of claim 1 wherein the cutting blade handle is rotatably secured to the end of the measure rod at a point on the handle which allows it to reach the end of the unit that the measure rod is near, wherein the blade can start at the edge of the wallboard in line with the beginning of the channel.

7. The cutter unit of claim 1 wherein the channel features cylindrical rollers symetrically opposite each other at each end of the channel secured axially parallel to the channel walls in wells which allow a small portion of the rollers into the channel which channel is wide enough to accommodate wallboard of various thicknesses.

* * * * *